United States Patent [19]

Peterson

[11] 4,447,015

[45] May 8, 1984

[54] TOILET TISSUE DISPENSING DEVICE

[76] Inventor: Kenneth E. Peterson, 9617 Little Cir., Bloomington, Minn. 55437

[21] Appl. No.: 438,055

[22] Filed: Nov. 1, 1982

[51] Int. Cl.[3] ..... B65H 19/00

[52] U.S. Cl. ..... 242/55.2; 242/129.8

[58] Field of Search ..... 242/55.2, 55.3, 55.53–55.55, 242/129.8; 225/46, 47; 248/565, 566, 578, 594, 600, 616; D6/96, 97

[56] References Cited

U.S. PATENT DOCUMENTS

| | | | |
|---|---|---|---|
| 1,251,892 | 1/1918 | Johnson | 242/55.2 |
| 1,433,835 | 10/1922 | MacCormac | 242/55.2 |
| 1,670,120 | 5/1928 | Melling | 242/55.2 |
| 2,073,429 | 3/1937 | Spicher | 242/55.2 |
| 2,699,903 | 1/1955 | Montgomery | 242/55.2 |
| 2,858,994 | 11/1958 | Sarro | 242/55.2 |
| 3,140,059 | 7/1964 | Lusebrink | 242/55.2 |
| 3,170,652 | 2/1965 | Kennedy | 242/55.2 |
| 3,229,954 | 1/1966 | Hendricks | 248/600 |
| 4,071,200 | 1/1978 | Stone | 242/55.2 |

FOREIGN PATENT DOCUMENTS

| | | | |
|---|---|---|---|
| 1117222 | 6/1968 | United Kingdom | 248/600 |

*Primary Examiner*—Leonard D. Christian

*Attorney, Agent, or Firm*—Leo Gregory

[57] ABSTRACT

A toilet tissue holder consisting of a tubular roller having flexible ribs to frictionally hold a roll of tissue and providing for the inclusion within the roller of such a particular adjusted weight with regard to the tear strength of the tissue carried thereon that with a pull or tear motion, a desired number of sheets will be removed avoiding the free rolling of the tissue or such stiffness that single sheets are removed with effort.

2 Claims, 4 Drawing Figures

TOILET TISSUE DISPENSING DEVICE

BACKGROUND OF THE INVENTION

1. Field of Invention

This invention relates to a toilet tissue holder.

2. Description of the Prior Art

There are many arrangements used in the prior art to restrict the rotation of a toilet tissue holder to prevent freely unrolled lengths of paper from occurring. Known to be used are springs which increase tension upon the removal of sheets of paper to the point at which the tension is greater than the tear strength of the paper at which point there is a separation of paper from the roll.

It is also known in the art to have spring means and in one known case a weight which upon one or more sheets of paper being dispensed causes a reverse rotation of the holder.

Toilet tissue varies as to weight or thickness and whether the sheets are of a single or double ply, with a consequence that the tear strength of the tissue has substantial variances.

With regard to tear strength, some rolls of tissue which have considerable tear strength will result in unwanted lengths of tissue being pulled out or unrolled, leading to waste. Some spring or spring and weight combinations of restraints in a roller are so stiff that the tissue tears off one sheet at a time and not in desired lengths.

It is desirable to have a simplified structure of a toilet tissue holder which embodies structure permitting desired lengths of tissue to be removed from a roll of tissue.

SUMMARY OF THE INVENTION

The invention herein comprises a wall mounted toilet tissue holder of which the novelty is contained within a cylindrical holder having circumferentially spaced resilient ribs adapted to center and frictionally engage a roll of paper thereon and having therein a plurality of adjustable weights. The amount of weight contained within the holder will correspond to the degree of tear strength of the toilet tissue used therewith whereby the holder is rotated only to the point that one or more sheets of tissue, as desired, are torn from the roll and the roll is stabilized to remain at the point of the tear without having any unwanted additional sheets freely dispensed by the roller due to momentum.

It is an object of this invention to have a plurality of weights contained within the holder to permit their adjustment to control the rotation of the roller to the point at which only the desired number of sheets of paper are removed from the roller.

These and other objects and advantages of the invention will be set forth in the following description made in connection with the accompanying drawings in which like reference characters refer to similar parts throughout the several views.

DESCRIPTION OF A PREFERRED EMBODIMENT

Figure 1:
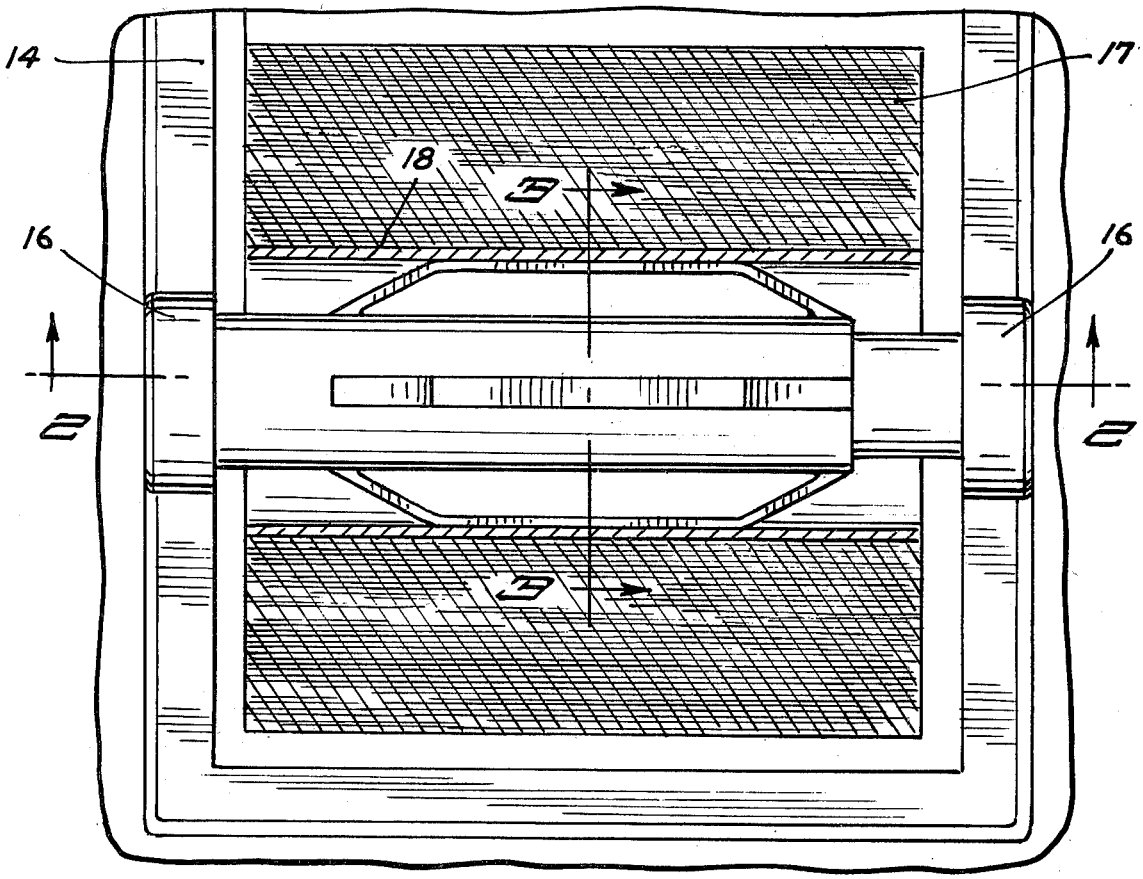
FIG. 1 is a broken view in front elevation.

Referring to the drawings, the toilet tissue holder or dispensing device comprising the invention herein is indicated generally by the reference numeral 10.

In FIG. 1, said device 10 is indicated in an operating position disposed within a conventional type of a recessed wall fixture 12 having a semi-cylindrical cavity 14 and a pair of spaced retainers 16 into which said dispensing device will have its end portions journaled. A roll of tissue 17 is shown having a core 18.

Comprising said device 10 is a hollow cylindrical roller 20 which may be formed of a suitable metal or plastic material having a small annular flange forming a shoulder 22 at one end thereof and having an unobstructed end opening 24 at the other end thereof which is internally threaded at 24*a*.

Disposed within said roller 20 is a cylindrical end plug 26 having an inner portion 27 thereof abutting said shoulder 22 and having an outwardly extended portion 28 of reduced diameter having extending therefrom a pivot 29, said pivot to be journaled into one of said retainers 16.

Next, disposed within said roller under compression is a coil spring 32 seated against the inner end of said plug 26.

Disposed within said roller to bear against said coil spring are a plurality of cylindrical weights 35 designated here as 35*a, b, c* and *d*. Said weights preferably are formed of lead adapted to fit within said roller 20 which is indicated here as having an inner diameter on the order of seven-eighths inches. The weights preferably will vary as to size. As illustrated, the larger weight 35*a* is on the order of one inch in length and the others on the order of three-eighths inches in length.

Said weights or any desired number of them disposed within said roller will bear inwardly against said coil spring and be retained within said roller 20 by an end plug 38 having an inwardly projecting threaded portion 38*a* of reduced diameter which is threaded into said roller end 24. Said plug has an outward projecting pivot 39 which is journaled into the other of said retainers 16.

Figure 2:
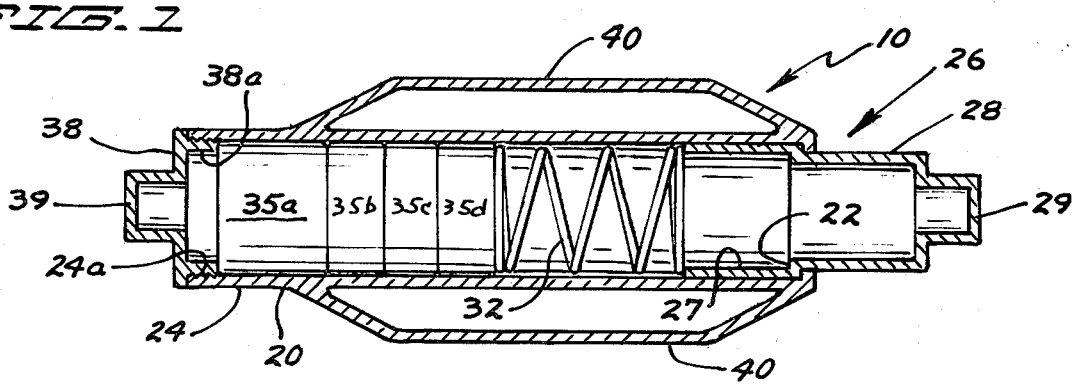
FIG. 2 is a view in horizontal section taken on line 2—2 of FIG. 1 as indicated.
Figure 3:
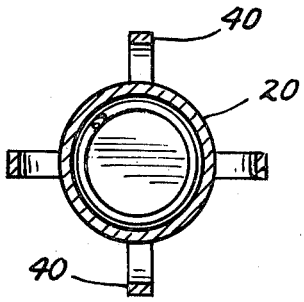
FIG. 3 is a view in vertical section taken on line 3—3.
Figure 4:
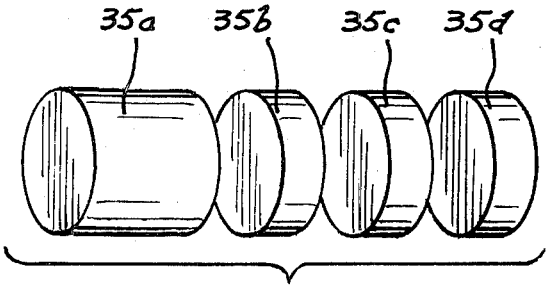
FIG. 4 is a composite view in perspective of a detail of structure.

Spaced equally about said roller 20 and extending longitudinally thereof are a plurality of flexible rib members 40 radially spaced from said roller and as shown having tapered end portions as at 40*a* engaging said roller to be integral therewith. Said ribs are indicated as being formed as angled strips, spaced at 90° intervals about said roller. Said strips may be formed of a material to be formed integral with said roller or may be suitably secured thereto. Said rib members will flex sufficiently to center and hold upon said roller 20 rolls of tissue having various sized core diameters. It will be noted in FIG. 2 that said ribs are centrally positioned longitudinally of the assembled device 10.

OPERATION

The structure herein provides for an appropriate weighting of the roller 20 relative to the particular tissue which will be used. The specific adjustment of weight will be on a trial and error basis whereby as a result of the adjustment only a desired number of sheets of tissue will be removed from a roll with a normal tear motion of the hand. It is readily seen that adjustment of the weights within said roller is readily accomplished by removal of the end plug 38.

The ribs 40 are of such flexibility as to accommodate very nicely rolls of paper having different sized cores in radially centering and holding said rolls.

The device as herein disclosed has operated very successfully in practice.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A toilet tissue dispensing device in connection with a fixture holding the same, said device having in combination a tubular roller carrying a roll of toilet tissue, said roller comprising a hollow body, a plurality of flexible longitudinal ribs integral with said body and projecting outwardly thereof spaced thereabout, a plurality of weight members disposed within said body, the weight of said weight members being such as to restrain the rotation of said roller by being adjusted to the tear strength of the tissue paper carried by said roller thereby preventing a resulting free rotation of said roller, and means within said body preventing relative rotation of said weight members.

2. A toilet tissue dispensing device in connection with a fixture holding the same, said device having in combination a tubular roller having thereon a roll of toilet tissue, said roller comprising a hollow body having open ends, a plurality of flexible longitudinal ribs integral with said body and projecting outwardly thereof spaced thereabout, an annular flange at one end of said body, a cylindrical end plug having a portion thereof disposed into said body through said one end thereof, said end plug having an annular shoulder engaging the inner side of said annular flange being retained thereby, said end plug having a portion of reduced diameter extending outwardly of said body forming a pivot, a compression spring disposed within said body abutting said end plug, a plurality of cylindrical weight members disposed within said body engaging said spring, an end plug forming a pivot being externally threaded at one end thereof and being disposed into said other end of said body, and said weight members being adjusted as to weight to the tear strength of said roll of toilet tissue, said weight being such as to restrain the rotation of said roller upon removal of sheets from said roll of tissue thereon and thus prevent the free rotation of said roller.

* * * * *